US006257402B1

(12) United States Patent
Hedman

(10) Patent No.: US 6,257,402 B1
(45) Date of Patent: Jul. 10, 2001

(54) PACKAGE HAVING VAPOR PRESSURE CONTROL FOR BATTERIES

(75) Inventor: Jonathan W. Hedman, Burnt Hills, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/544,587

(22) Filed: Apr. 6, 2000

(51) Int. Cl.[7] ..... B65D 81/24; B65D 85/30; B65B 29/00

(52) U.S. Cl. ..... 206/204; 53/400; 206/320; 206/704; 206/461

(58) Field of Search ..... 206/703, 704, 206/705, 204, 320, 461, 471; 53/400; 429/48, 57, 126

(56) References Cited

U.S. PATENT DOCUMENTS

| | | | | |
|---|---|---|---|---|
| 1,871,419 | | 8/1932 | McKee . | |
| 2,368,140 | | 1/1945 | Johnson . | |
| 3,629,009 | | 12/1971 | Bennett . | |
| 4,015,708 | | 4/1977 | Kelm . | |
| 4,209,091 | * | 6/1980 | Lieberman | 206/704 |
| 4,404,266 | | 9/1983 | Smilanich . | |
| 4,674,630 | | 6/1987 | Kirck . | |
| 4,997,082 | | 3/1991 | Durocher . | |
| 5,035,731 | | 7/1991 | Spruill et al. . | |
| 5,079,106 | | 1/1992 | Urry . | |
| 5,165,947 | | 11/1992 | Colucci et al. . | |
| 5,203,455 | * | 4/1993 | Hewett et al. | 206/704 |
| 5,219,676 | * | 6/1993 | Bullock et al. | 206/204 X |
| 5,229,223 | | 7/1993 | Hyland . | |
| 5,270,128 | | 12/1993 | Reichert et al. . | |
| 5,306,580 | | 4/1994 | Mansfield, Jr. et al. . | |
| 5,529,177 | | 6/1996 | Podd et al. . | |
| 5,843,597 | | 12/1998 | Getz . | |
| 6,157,306 | * | 12/2000 | Mularoni | 206/204 X |

FOREIGN PATENT DOCUMENTS

| | | | | |
|---|---|---|---|---|
| 0259830 | * | 9/1988 | (DE) | 206/204 |

* cited by examiner

*Primary Examiner*—Bryon P. Gehman
(74) *Attorney, Agent, or Firm*—Russell H. Toye, Jr.; Robert W. Welsh

(57) ABSTRACT

A package for storing one or more batteries comprising a container defining an encapsulated hollow region and having walls that provide a first vapor permeability. The package contains an air cell or air-assisted cell battery housed within the container. Also housed within the container is a vapor control medium for providing controlled vapor flooding within the container so as to substantially match the vapor pressure of the hollow region with the vapor pressure within the air cell battery. The package allows for an electrically-operated device to be assembled with the air cell battery and housed ready for use within the package, while advantageously controlling the vapor pressure to minimize cell performance degradation.

34 Claims, 1 Drawing Sheet

PACKAGE HAVING VAPOR PRESSURE CONTROL FOR BATTERIES

BACKGROUND OF THE INVENTION

The present invention generally relates to packages for containing one or more batteries, and more particularly relates to a package for containing an air cell or air-assisted cell battery for use with an electrically operated device.

Conventional electrochemical cells such as miniature alkaline air cell and air-assisted cell batteries are commonly employed for supplying a battery voltage in a generally disk or cylindrical-shaped construction. Examples of conventional miniature air cell batteries are disclosed in U.S. Pat. Nos. 5,306,580, 4,404,266, and 5,843,597. Examples of air-assisted cell batteries are disclosed in U.S. Pat. Nos. 5,079,106, 5,229,223, and 5,270,128. Air cell batteries and air-assisted cell batteries are commonly employed in electrically operated devices, such as hearing aids and pagers. The conventional air cell battery has an anode typically containing zinc powder as the active material, and a cathode which employs oxygen received through an air inlet from the surrounding ambient air as the active material. The conventional air-assisted cell battery, generally employs a cathode containing an active electrochemical material such as manganese dioxide or silver oxide and further employs oxygen received through an air inlet from the surrounding atmosphere air to regenerate the catalyst to charge the active material.

Alkaline batteries that require oxygen from the ambient air received through an air inlet are generally packaged and sold with a removable tab, typically made up of an adhesive tape, that covers the air inlet openings formed in the cathode container. The removable tabs prevent atmospheric air from freely entering the cell when the openings are covered, and is removable to allow for atmospheric air to enter the cathode container to allow for electrochemical reaction to occur. Vapor pressure within the cell is generally determined by the electrolyte in the cell which typically comprises a salt solution, such as an aqueous solution of potassium hydroxide. The removable tab serves to prevent excessive moisture from entering the cell as well as to prevent excessive moisture from leaving the cell. Excessive moisture collection in the cell will consume the void volume, thereby leaving reduced volume for reaction product and resulting in premature shutdown of the battery. Excessive migration of moisture from the battery will dry up the cell and result in inefficient discharge. By covering the air inlet openings with a removable tab, air cell and air-assisted cell batteries may be stored for long periods of time prior to use, without suffering from noticeably reduced performance due to excessive or inadequate amounts of moisture in the cell.

It is sometimes desirable to package electrically-operated devices, such as hearing aids, with one or more miniature batteries disposed in the device so that the device is ready to operate. For such devices, it is desirable to provide the battery intact in the device so the device is ready to operate, without requiring a user to remove a tab from the air inlet openings on the battery container. However, by omitting the covering tab, the reactive components of the battery are exposed to the vapor conditions of the surrounding environment. One proposed solution to minimizing the adverse effects of certain vapor conditions is to package the battery and electrically-operated device together in a low-permeability polymeric blister package. However, conventional blister packages are generally vapor permeable, and reduced vapor permeable materials add substantially to the package cost As a consequence of vapor permeation, vapor may enter or leave the package when the vapor pressure within the package is different from the vapor pressure of the surrounding atmosphere, and may thereby adversely affect the performance of the packaged battery. Additionally, carbon dioxide may also permeate the package and react with the electrolyte to adversely affect cell performance.

Accordingly, there is a need, heretofore unfulfilled, to provide a package for housing one or more air cell or air-assisted cell batteries in a manner that does not require a tab covering the air inlet opening(s) of the battery. It is further desirable to provide for a battery package that prevents excessive moisture transfer entering or exiting the cell. It is further desirable to provide for such a package that includes an electrically-operated device containing an air cell or air-assisted cell battery ready to operate.

SUMMARY OF THE INVENTION

The present invention minimizes the performance degradation of an air dependent electrochemical cell, such as an air cell battery or air-assisted cell battery, packaged in a display package by controlling the vapor pressure within the package and eliminating the need for a removable tab to cover the air inlet opening(s) to the battery container. To achieve this and other advantages, and in accordance with the purpose of the invention as embodied and described herein, the present invention provides for a package for storing one or more batteries. The package comprises a container defining an encapsulated hollow region and having walls that provide a first vapor permeability. The package contains an air dependent battery housed within the container. Also housed within the container is a vapor control medium for providing controlled vapor flooding within the container so as to substantially match the vapor pressure of the hollow region with the vapor pressure within the battery. The package allows for an electrically-operated device assembled with the air dependent battery to be housed ready for use within the package, while advantageously controlling the vapor pressure to minimize battery performance degradation.

These and other features, advantages and objects of the present invention will be further understood and appreciated by those skilled in the art by reference to the following specification, claims and appended drawings.

DETAILED DESCRIPTION OF THE PREFERRED EMBODIMENTS

The preferred embodiment of the present invention is described herein in conjunction with a miniature alkaline air cell, such as any of the type disclosed in U.S. Pat. Nos. 5,306,580, 4,404,266, and 5,843,597, packaged together for use in an electrically-operated device, such as a hearing aid. However, it should be appreciated that the teachings of the present invention are applicable to the packaging of one or more air receiving batteries which generally have an air inlet and use gas in the air as a depolarizer, that are packaged either alone or in combination with any of a number of electrically-operated devices for sale to consumers. Examples of air receiving batteries include air cell batteries, such as alkaline zinc-air batteries, and air-assisted cell batteries.

Figure 1:
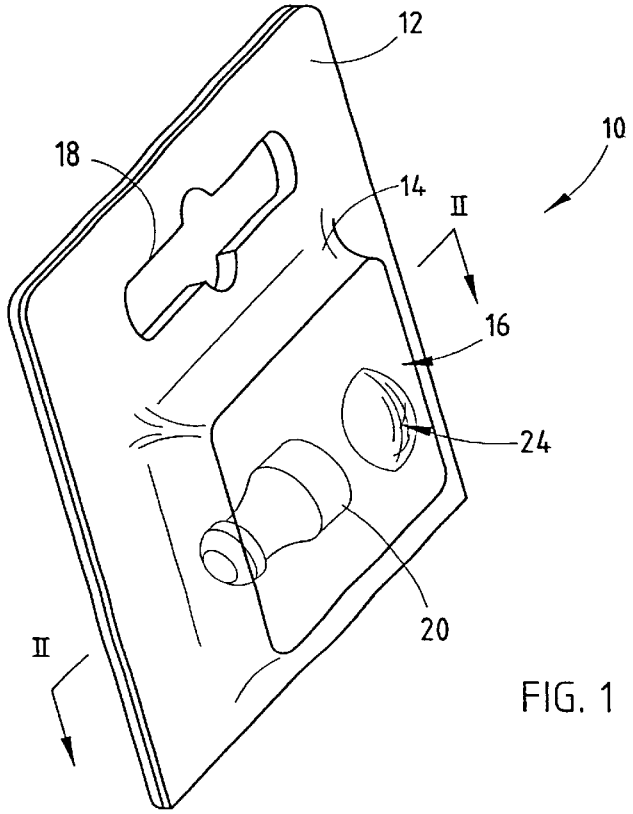
FIG. 1 is a perspective view of a display package containing an electrically operated hearing aid equipped with an air cell battery and a vapor pressure control medium according to the present invention.

Referring to FIG. 1, a clear thermoformed polymeric blister package 10 is illustrated containing an electrically-operated device 20, such as a hearing aid, for display and sale to consumers. Blister package 10 is generally made up of a rear polymeric layer 12 sealed to a front polymeric layer 14 and forming a hollow region 16 therebetween. Layers 12 and 14 may include a single piece of polymeric blister material folded about one edge, such as the bottom edge, and heat sealed or otherwise closed together to encapsulate and form the hollow region 16. The walls of layers 12 and 14 encapsulating hollow region 16 have a defined surface area and thickness, and exhibit a determinable vapor permeability. It is preferred that the vapor permeability of layers 12 and 14 forming hollow region 16 be relatively low to minimize the vapor exchange between the hollow region 16 and the surrounding outside ambient environment.

Disposed within hollow region 16 of package 10 is an electrically-operated device 20, such as a hearing aid device. The electrically-operated device 20 contains an air receiving cell battery 22 for electrically powering the device 20. As is generally known in the art, battery 22 has one or more air inlet openings 30 (FIG. 2) formed in the cathode container for receiving oxygen from air in the surrounding environment. According to one embodiment, battery 22 may include an air cell battery in which oxygen received through the air inlet openings 30 from the atmospheric air acts as an active cathode material. According to another embodiment, battery 22 may include an air-assisted cell battery in which oxygen received from the air regenerates the catalyst. Battery 22 is preferably assembled within a compartment in electrically-operated device 20 prior to packaging and is ready to operate without requiring handling of the battery 22. Accordingly, the electrically-operated device 20 may be removed from the package 10 and immediately employed for its intended application, without having to handle the battery 22 to remove a removable tab as is generally required in the conventional miniature air cell and air-assisted cell battery packaging art.

Figure 2:
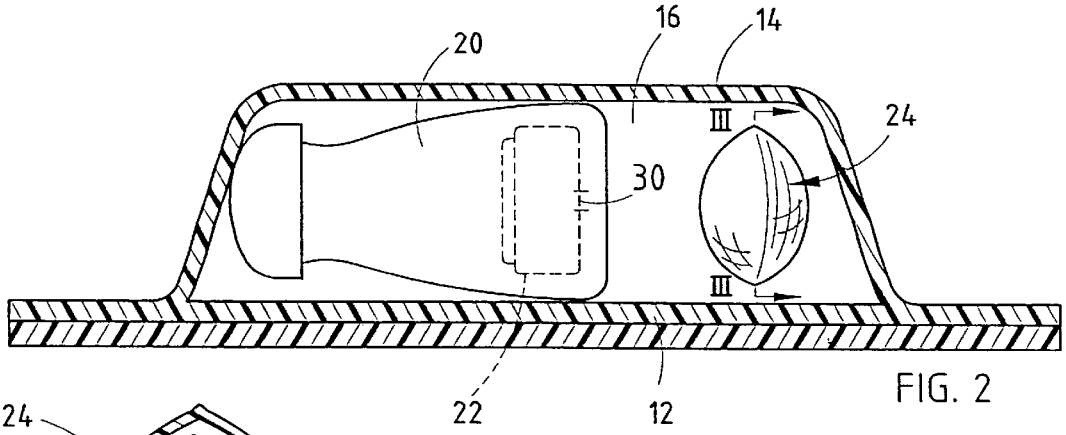
FIG. 2 is a cross-sectional view of the package taken through lines II—II of FIG. 1.
Figure 3:
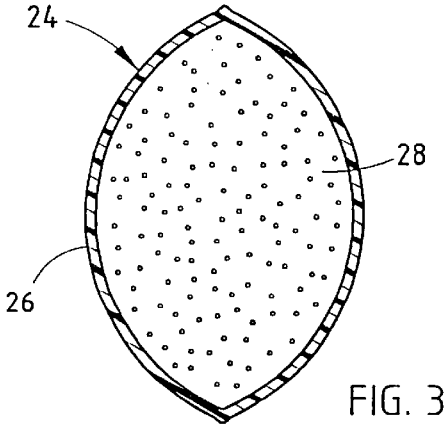
FIG. 3 is an enlarged cross-sectional view of the vapor pressure control medium taken through lines III—III of FIG. 2.

Referring to FIGS. 2 and 3, a vapor pressure control medium in the form of a packet 24 is provided within the hollow region 16 of package 10. Vapor control packet 24 preferably includes an aqueous salt solution 28 having a known vapor pressure. Vapor control packet 24 also includes a highly permeable covering 26 which may be heat sealed closed along a seam as shown. Vapor control packet 24 may be integrally formed within blister package 10 or may be disposed anywhere within the hollow region 16 of blister package 10 to control the vapor pressure therein. The salt solution 28 contained within packet 24 is selected so that the known partial pressure of the vapor is substantially equal to the partial pressure of the vapor in the battery 22. The permeability of the blister package 10 is selected so as to be substantially less than the permeability of the outer covering 26 of packet 24 so that the vapor permeability between the hollow region 16 and outside atmosphere is minimized, while allowing vapor permeation to occur between the packet 24 and hollow region 16.

The outer covering 26 of packet 24 enclosing the salt solution 28 should be hydrophobic, inert, non-reactive, and highly permeable to vapor flow, but is preferably non-wettable. Examples of suitable materials for the permeable outer covering 26 include hydrophobic microporous materials such as polytetrafluoroethylene (PTFE) or polypropylene. Other examples of suitable non-porous polymers for use in covering 26 include dimethyl silicone rubber and a block copolymer of silicon and polycarbonate, such as MEM-213, which is commercially available from General Electric. The aforementioned block copolymer of silicon and polycarbonate has the added advantage of being heat formable and easily sealed closed.

The salt solution 28 can be tailored to the specific needs of the intended application. Ideally, the salt solution 28 has a low toxicity and a low reactivity. Preferably, the salt solution 28 is substantially identical to the salt solution in the cell (i.e., having the same concentration of the same salt in the same solvent) to be most effective over a broad range of environmental conditions. Examples of salt solutions include sodium hydroxide, potassium hydroxide in a relative percentage equal to the potassium hydroxide found in the electrolyte of the cell or in a lower concentration, and other potassium salts. The salt solution 28 may include a solution of potassium hydroxide and water in which the amount of potassium hydroxide is adjusted to be substantially equal to the percentage of potassium hydroxide in the electrolyte in the battery 22. Other salt solutions 28 may likewise be adjusted so as to provide substantially equal vapor pressure as the vapor pressure present in the electrolyte in battery 22. It should be appreciated that an increase in salt concentration provides a lower vapor pressure which reduces the partial pressure of the vapor in hollow region 16. The concentration of salt in salt solution 28 to achieve a desired partial pressure may depend on a number of factors including: the type of battery, the type of electrolyte and potassium hydroxide concentration, the amount of water present in the electrolyte, the expected period of time the battery will be stored in the package, the expected vapor conditions that the package will be subjected to, as well as the ambient air temperature.

In lieu of the vapor control packet 24 having an outer covering 26, a stabilized gel containing the salt solution 28 may be employed as an alternative. Additionally, additives to the aqueous salt solution 28 may be employed to serve as getters for other compounds that might otherwise adversely affect the performance of the air cell battery 22. For example, a hydroxide solution could be employed as a getter to reduce or eliminate carbon dioxide that permeates through the blister package. The $C0_2$ getter may be employed in either the gel alternative or may be employed within the vapor control packet 24.

By employing vapor control packet 24, an air dependent cell battery 22 can be packaged for extended periods of time within a blister package 10 having a vapor pressure controlled. environment, which minimizes the vapor permeation that may occur through the package 10. It should be appreciated that the gas exchange between the blister package 10 and the surrounding ambient air generally does not change. Instead, the effect on the air dependent cell battery 20 is reduced in direct proportion to the ratio of liquid (water) in the battery 20 to liquid (water) in the blister package 10. For example, consider an air cell battery containing 100 milligrams of water subjected to an atmosphere in which the battery 22 loses twenty (20) milligrams over a period of two years. If a permeable vapor control packet 24 of nine hundred (900) milligrams of potassium hydroxide and water is placed in the blister package 10, the same total loss of twenty (20) milligrams is believed to occur, but only two (2) milligrams of water are lost from the battery 20, while the remaining eighteen (18) milligrams of water are lost from the packet 24. Accordingly, the amount of water lost from battery 10 is significantly reduced by employing the present invention.

The packaging arrangement of the present invention provides a solution to water vapor transport between ambient atmospheric air and one or more packaged air receiving cell batteries without requiring the development of extremely low permeability barrier materials. The degree of buffering from environmental effects can be optimized for this specific application. For example, smaller cells containing less water content will generally require more vapor control than larger cells containing greater water content, and thus this can be easily done by increasing the amount of solution in vapor control packet 24.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A package for storing one or more air receiving batteries, said package comprising:

a container defining an encapsulated hollow region, said container having walls exhibiting a first vapor permeability;

an electrically operated device containing an air receiving battery, said battery having a vapor pressure; and a vapor control medium for providing controlled vapor flooding within the container so as to substantially match a vapor pressure of the hollow region with the vapor pressure within the battery.

2. The package as defined in claim 1, wherein said vapor control medium comprises an aqueous solution.

3. The package as defined in claim 1, wherein said container comprises a thermoformed blister material.

4. The package as defined in claim 1, wherein said vapor control medium comprises a cover material having a second vapor permeability substantially greater than the first permeability of the container.

5. The package as defined in claim 4, wherein said cover material comprises a microporous PTFE.

6. The package as defined in claim 1, wherein said vapor control medium further comprises a salt solution.

7. The package as defined in claim 6, wherein said salt solution is substantially identical to a salt solution in the battery.

8. The package as defined in claim 6, wherein said salt solution comprises potassium hydroxide.

9. The package as defined in claim 6, wherein said salt solution comprises sodium hydroxide.

10. The package as defined in claim 6, wherein said salt solution provides a vapor pressure within said hollow region.

11. The package as defined in claim 1, wherein said air receiving battery comprises an air cell.

12. The package as defined in claim 11, wherein said air cell comprises a zinc-air cell.

13. The package as defined in claim 1, wherein said air receiving battery comprises an air-assisted cell.

14. The package as defined in claim 1, wherein said electrically operated device comprises a hearing aid.

15. A package for storing one or more air receiving batteries, said package comprising:

a container defining an encapsulated hollow region, said container having walls exhibiting a first vapor permeability;

an air receiving battery having a vapor pressure; and a vapor control medium for providing controlled vapor flooding within the container so as to substantially match a vapor pressure of the hollow region with the vapor pressure within the battery.

16. The package as defined in claim 15, wherein said vapor control medium comprises an aqueous solution.

17. The package as defined in claim 15 further comprising an electrically operated device contained within said container, wherein said battery is assembled to provide electrical power to said electrically-operated device.

18. The package as defined in claim 15, wherein said container comprises a thermoformed blister material.

19. The package as defined in claim 15, wherein said vapor control medium comprises a cover material having a second vapor permeability substantially greater than the first vapor permeability of the container.

20. The package as defined in claim 19, wherein said cover material comprises a microporous PTFE.

21. The package as defined in claim 15, wherein said vapor control medium comprises a salt solution.

22. The package as defined in claim 21, wherein said salt solution is substantially identical to a salt solution in the battery.

23. The package as defined in claim 21, wherein said salt solution comprises potassium hydroxide.

24. The package as defined in claim 21, wherein said salt solution comprises sodium hydroxide.

25. The package as defined in claim 21, wherein said salt solution provides a vapor pressure within said hollow region.

26. The package as defined in claim 15, wherein said air receiving battery comprises an air cell.

27. The package as defined in claim 26, wherein said air cell comprises a zinc-air cell.

28. The package as defined in claim 15, wherein said air receiving battery comprises an air-assisted cell.

29. A method of packaging one or more air receiving batteries, said method comprising the steps of:

providing a container defining an encapsulated hollow region and having walls exhibiting a first vapor permeability;

disposing an air receiving battery having a vapor pressure within said container; and disposing a vapor control medium within said container, wherein said vapor control medium provides controlled vapor flooding within the container so as to substantially match a vapor pressure of the hollow region with the vapor pressure within the battery.

30. The method as defined in claim 29 further comprising the steps of disposing the air receiving battery in an electrically operated device and disposing said device and battery together in said container.

31. The method as defined in claim 29 further comprising the step of disposing a salt solution within a cover material having a second vapor permeability substantially greater than said first vapor permeability to provide for said vapor control medium.

32. The method as defined in claim 29, wherein said vapor control medium solution comprises an aqueous salt solution.

33. The method as defined in claim 32, wherein said salt solution comprises potassium hydroxide and water.

34. The method as defined in claim 32, wherein said salt solution is substantially identical to a salt solution in the battery.

* * * * *